US005735759A

United States Patent [19]

Lin et al.

[11] Patent Number: 5,735,759

[45] Date of Patent: Apr. 7, 1998

[54] GAME RACKET

[76] Inventors: Se Lin; Johnny Lin, both of No. 747, Chong San Road, Ser Nan Tsuen, Shern Gan Hsiang, Taichung Hsien, Taiwan

[21] Appl. No.: 823,074

[22] Filed: Mar. 24, 1997

[51] Int. Cl.[6] ..... A63B 49/00

[52] U.S. Cl. ..... 473/540; 473/543; 473/544

[58] Field of Search ..... 473/528, 529, 473/532, 535, 536, 543, 544, 546, 540

[56] References Cited

U.S. PATENT DOCUMENTS

| | | | |
|---|---|---|---|
| 2,969,984 | 1/1961 | Presnick | 473/543 |
| 3,545,756 | 12/1970 | Nash | 473/540 |
| 3,814,423 | 6/1974 | Shockley et al. | 473/544 |
| 4,029,317 | 6/1977 | Malmström | 473/540 |
| 4,741,531 | 5/1988 | Szedressy | 473/540 |
| 5,188,359 | 2/1993 | Wu | 473/528 |
| 5,217,222 | 6/1993 | Rudell et al. | 473/528 |
| 5,294,114 | 3/1994 | Stillinger | 473/528 |
| 5,413,335 | 5/1995 | Braun | 473/532 X |

*Primary Examiner*—William E. Stoll

[57] ABSTRACT

A game racket includes an annular frame and a tube secured to the annular frame. An annular rib is engaged in the annular frame, and a network has a peripheral portion engaged with the annular rib and engaged in the annular frame for allowing the network to be secured to the annular frame without threading operation. The game racket may thus be made quickly and the manufacturing cost may thus be greatly decreased. The annular rib has one or more holes for engaging with the plastic material and for allowing the annular rib to be solidly secured in the annular frame.

2 Claims, 5 Drawing Sheets

GAME RACKET

BACKGROUND OF THE INVENTION

1. Field of the Invention

The present invention relates to a racket, and more particularly to a game racket.

2. Description of the Prior Art

Typical game rackets for entertaining purposes comprise a tube secured between a racket frame and a hand grip, and one or more threads threaded through the racket frame so as to form a striking surface. However, typical game rackets required to thread the threads manually such that the manufacturing speed is decreased and the manufacturing cost is greatly increased.

A game racket which is not required to be threaded is disclosed in U.S. Pat. No. 5,131,653 to Yu and comprises a circular body secured between two frames, and a network of strings secured to the circular body by ultrasonic welding process. However, the network may also be easily disengaged from the circular body.

The present invention has arisen to mitigate and/or obviate the afore-described disadvantages of the conventional game rackets.

SUMMARY OF THE INVENTION

The primary objective of the present invention is to provide a game racket which includes a striking surface that is not required to be threaded manually.

In accordance with one aspect of the invention, there is provided a game racket comprising an annular frame, a tube secured to the annular frame, an annular rib engaged in the annular frame, and a network including a peripheral portion engaged with the annular rib and engaged in the annular frame for allowing the network to be secured to the annular frame without threading operation. The network may thus be easily and solidly secured to the annular frame without manual force such that the game racket may be manufactured quickly and may be manufactured with decreased fees.

The annular frame is made of plastic material, the annular rib includes at least one hole for engaging with the plastic material and for allowing the annular rib to be solidly secured in the annular frame.

The tube includes a first end secured to the annular frame and includes a second end having a hand grip, the first end of the tube is flat.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
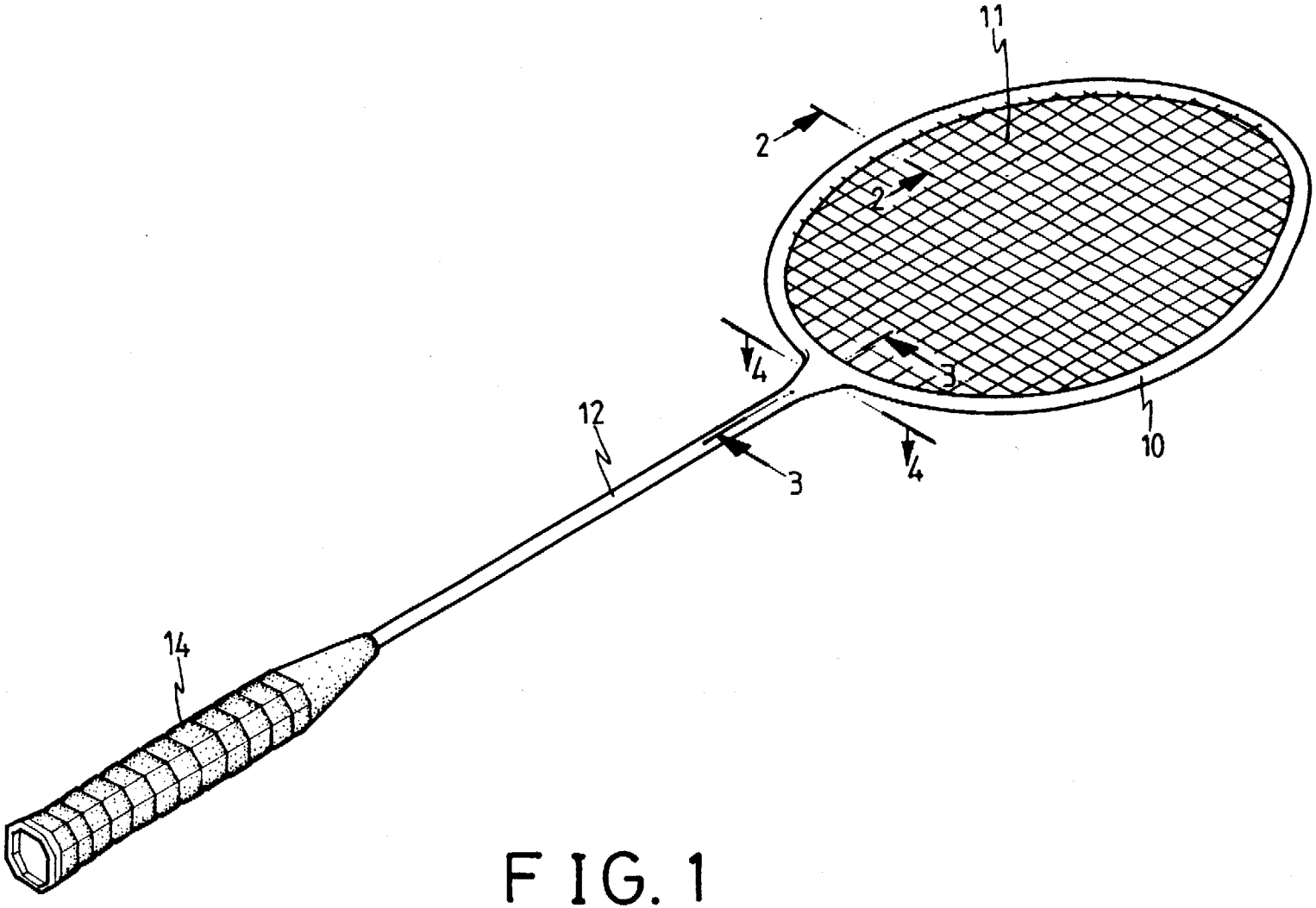
FIG. 1 is a perspective view of a game racket in accordance with the present invention.

Referring to the drawings, and initially to FIGS. 1–4, a game racket in accordance with the present invention comprises a tube 12 secured between a frame 10 and a hand grip 14. The frame 10 is formed with plastic material and includes a striking surface 11 formed by a network of strings. An annular rib 15 for reinforcing purposes is engaged in the frame 10. The network 11 has a peripheral portion engaged with the upper portion of the annular rib 15. The tube 12 includes a flat end 17 contacted and engaged with the annular rib 15 before the throat portion 16 is molded or formed. The engagement of the network 11 with the annular rib 15 may hold the network 11 and may prevent the network 11 from being easily become loose.

Figure 5:
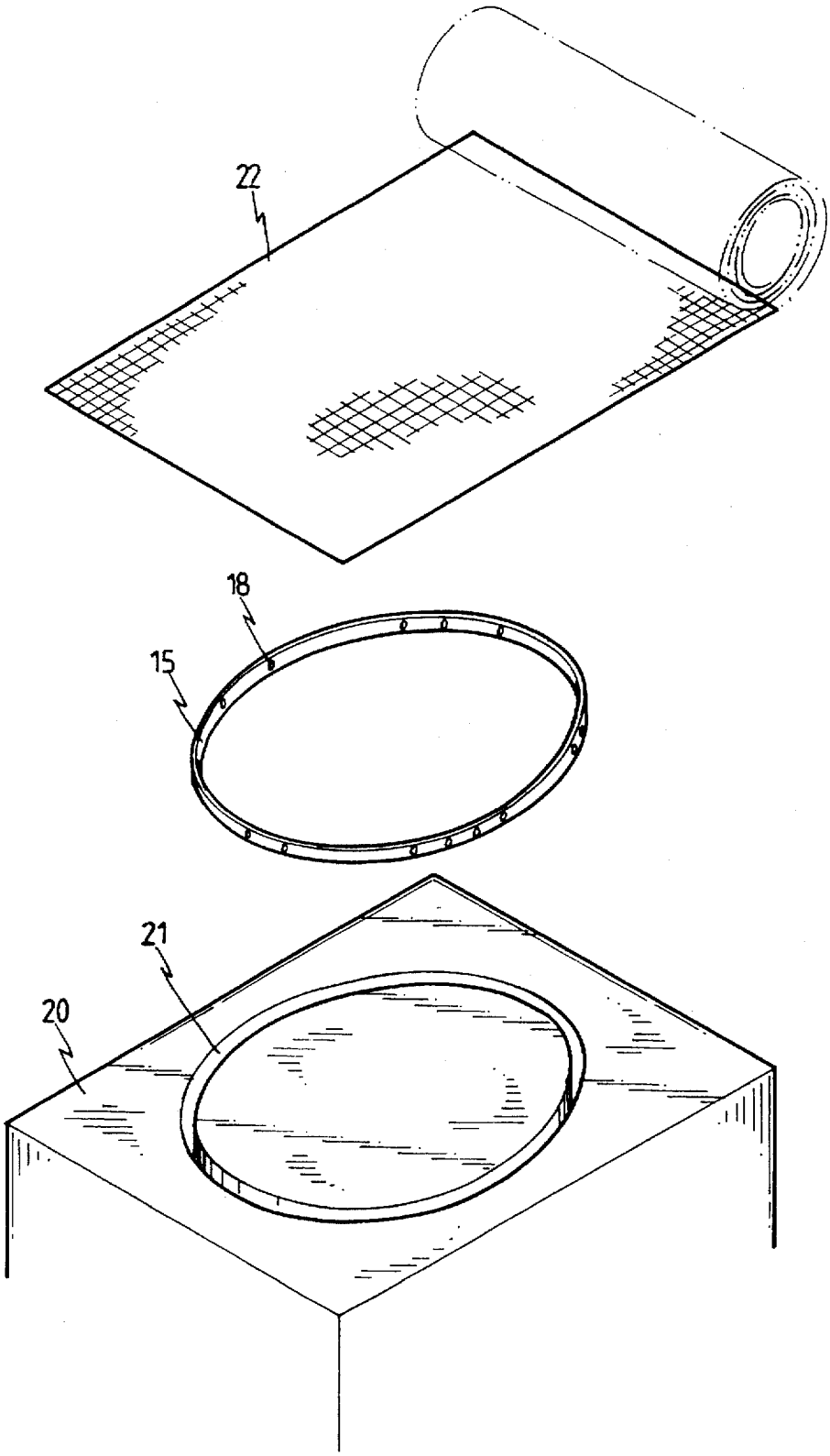
FIG. 5 is a partial exploded view showing the arrangement for making the game racket.
Figure 6:
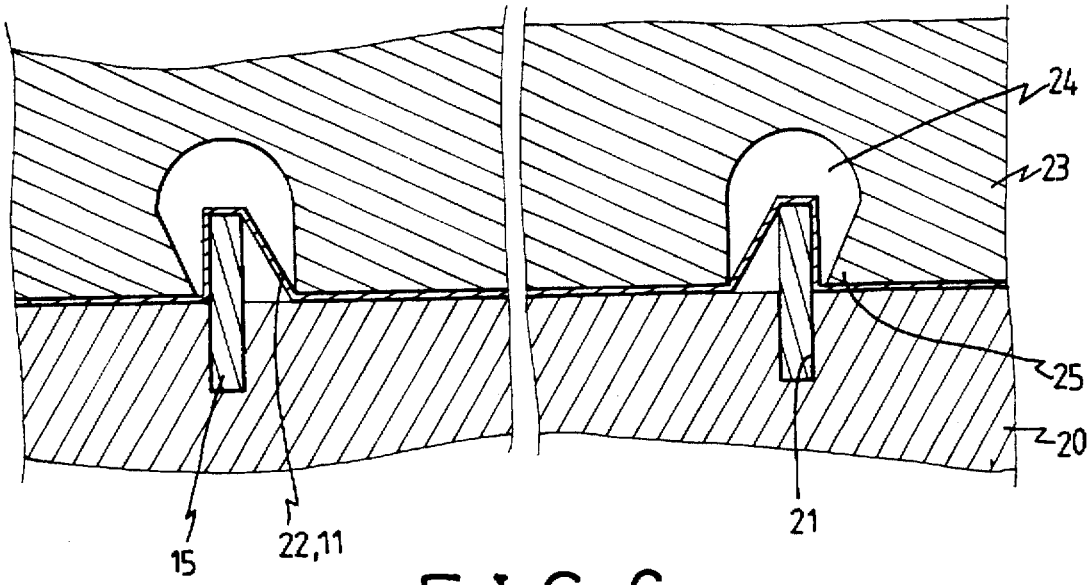
FIGS. 6, 7, 8 are cross sectional views illustrating the manufacturing of the game racket.
Figure 7:
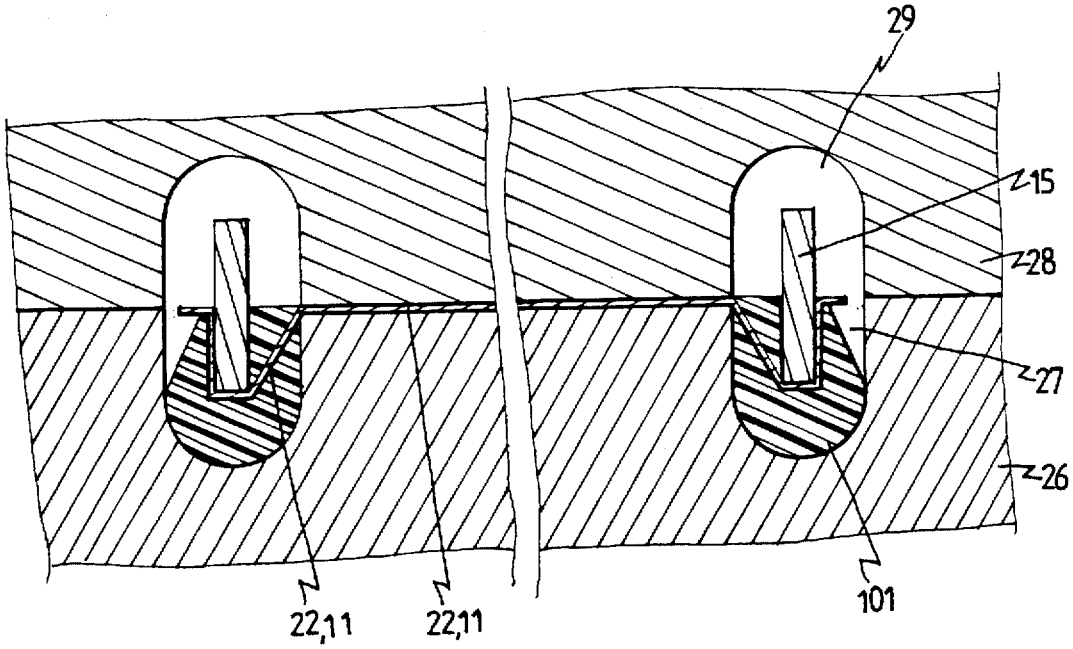

Referring next to FIGS. 5–7, a lower mold 20 includes an annular groove 21 for engaging with the lower portion of the annular rib 15. It is preferably that one or more holes 18 are formed in the annular rib 15 for engaging with the plastic material which forms the frame 10 and for allowing the annular rib 15 to be solidly engaged in the frame 10. A screen 22 is disposed above the annular rib 15 and is depressed toward the lower mold 20 by an upper mold 23 which includes a mold cavity 24 for receiving the upper portion of the annular rib 15 and the peripheral portion of the screen 22 which forms the network or the striking surface 11 of the game racket. The plastic material is then injected into the mold cavity 24 of the upper mold 23 (FIG. 6) for forming a prototype (FIG. 7) of the game racket. The plastic material may engage in the screen holes of the screen 22 and may engage in the holes 18 of the annular rib 15 such that the screen 22 and the annular rib 15 may be solidly secured together by the plastic material.

Figure 2:
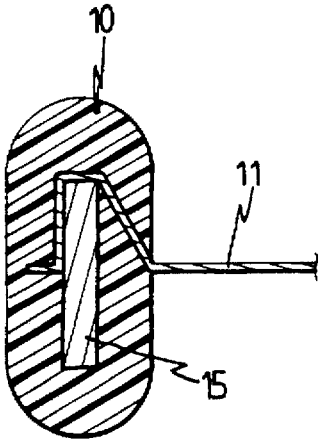
FIGS. 2, 3, 4 are cross sectional views taken along lines 2—2, 3—3, 4—4 of FIG. 1.
Figure 3:
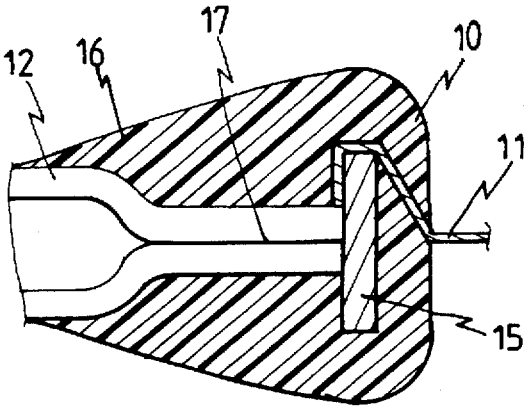
Figure 4:
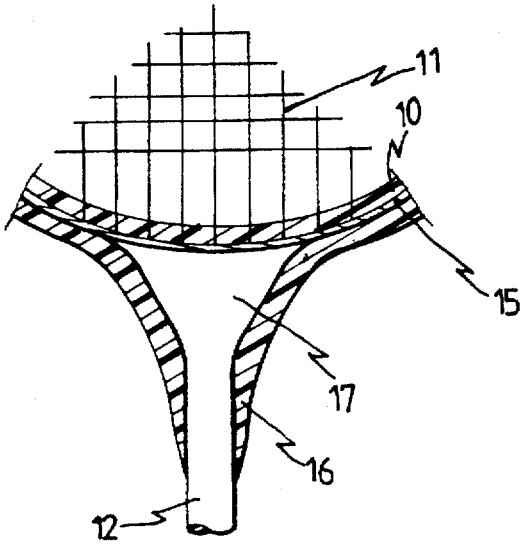

As shown in FIG. 7, the prototype 101 of the game racket is then disposed up side down in a mold cavity 27 of another lower mold 26. Another upper mold 28 is engaged on the lower mold 26 and has a mold cavity 29 communicating with the mold cavity 27 of the lower mold 26. The mold cavities 27, 29 have a shape corresponding to that of the frame 10 of the game racket. The plastic material is then injected into the mold cavity 29 for forming the frame 10 as shown in FIGS. 1 and 2, and for further solidly receiving the annular rib 15 in the frame 10. The screen or the network 11 may thus be solidly formed in the frame 10 without threading operations.

As best shown in FIG. 6, it is preferable that the upper mold 23 includes a projection 25 extended inward of the mold cavity 24 for pressing the outer peripheral portion of the screen 22 to engage with the outer peripheral surface of the annular rib 15 and for allowing the screen 22 to be solidly secured in the frame 10 by the annular rib 15. The prototype 101 of the frame 10 may be disengaged from the mold cavity 24 before the plastic material is hardened or cured.

Figure 8:
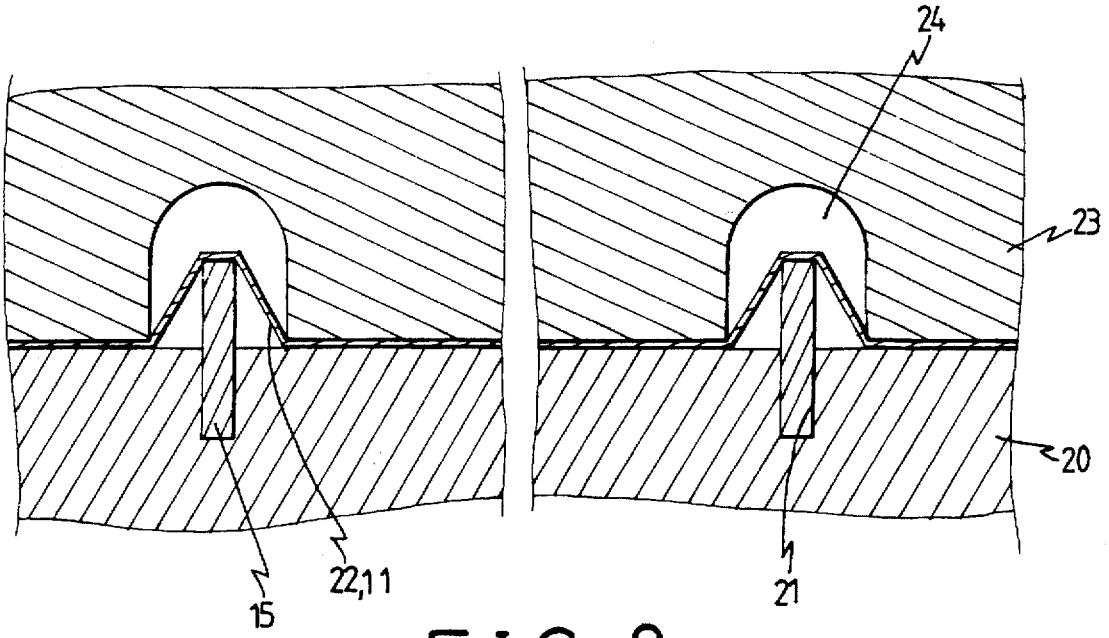

Referring next to FIG. 8, without the projection 25, the screen 22 may also be folded or bent relative to the annular rib 15 with a suitable inclination such that the screen 22 may also be solidly secured in the frame 10 by the annular rib 15.

Figure 9:
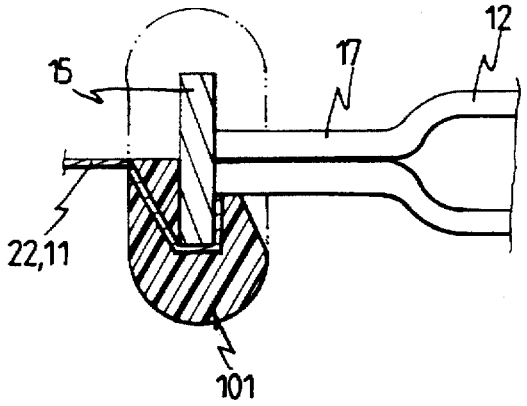
FIG. 9 is a schematic view illustrating the prototype of the game racket.

Referring next to FIG. 9, the flat end 17 of the tube 12 may be engaged with the annular rib 15 when only one half of the frame is formed and may be secured in the frame 10 when the throat 16 is molded. A small portion of the prototype 101 is required to be cut off for engaging with the flat end 17 of the tube 12. The flat end 17 may include one or more projection for engaging into the holes 18 of the annular rib 15 and for further solidly securing the tube 12 to the frame 10.

It is to be noted that the method for making the game racket as disclosed above is provided as an example for illustrating the formation of the game racket only. None of the prior game rackets disclose a game racket having a molded frame and having a network that may be directly and solidly secured in the frame without threading operation.

Accordingly, the game racket in accordance with the present invention includes a network that may be solidly formed and secured in the frame without threading operations.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A game racket comprising:

an annular frame made of plastic material, a tube secured to said annular frame, an annular rib engaged in said annular frame and including at least one hole for engaging with said plastic material and for allowing said annular rib to be solidly secured in said annular frame, and a network including a peripheral portion engaged with said annular rib and engaged in said annular frame for allowing said network to be secured to said annular frame without threading operation.

2. A game racket according to claim 1, wherein said tube includes a first end secured to said annular frame and includes a second end having a hand grip, said first end of said tube is flat.

* * * * *